US005287947A

United States Patent [19]

McSwain

[11] Patent Number: 5,287,947

[45] Date of Patent: Feb. 22, 1994

[54] VERTICAL SUPPORT GRID SYSTEM

[76] Inventor: Gregory A. McSwain, 4448 Schmittwods Ct., St. Louis, Mo. 63123

[21] Appl. No.: 917,959

[22] Filed: Jul. 24, 1992

[51] Int. Cl.[5] ..... E04G 7/00

[52] U.S. Cl. ..... 182/179; 182/178

[58] Field of Search ..... 182/179, 178; 52/638

[56] References Cited

U.S. PATENT DOCUMENTS

| | | | |
|---|---|---|---|
| 1,458,666 | 6/1923 | Stoppello | 182/178 X |
| 2,237,572 | 4/1941 | Manion | 182/178 X |
| 3,120,941 | 2/1964 | Cameron | 182/178 X |
| 3,533,592 | 10/1970 | Jennings | 182/179 X |

FOREIGN PATENT DOCUMENTS

| | | | |
|---|---|---|---|
| 3139642 | 3/1983 | Fed. Rep. of Germany | 182/113 |

*Primary Examiner*—Alvin C. Chin-Shue

*Attorney, Agent, or Firm*—Paul M. Denk

[57] ABSTRACT

A vertical support grid system, such as is used in the construction industry, to particularly provide elevated support for concrete forms and the like, includes vertically extending legs, cross-bracing diagonally spanning the distance between the legs, and tie-bars horizontally spanning the distance between the legs. A bracketing mechanism is provided which allows the quick and easy securement of the cross-braces and tie-bars to the legs at any desired location on the legs.

8 Claims, 1 Drawing Sheet

VERTICAL SUPPORT GRID SYSTEM

BACKGROUND OF THE INVENTION

This invention relates to vertical support systems for use in construction, and in particular to provide elevated support for concrete forms, scaffolding, and the like, and specifically pertains to a bracketing mechanism which allows for quick and easy attachment of cross-bracing and tie-bars to legs of the support system.

Vertical support systems, such as scaffolding, have long been used to provide access to various levels of an ongoing construction project. However, present scaffolding systems are generally fixed in the manner in which they can be set up. There is little or no room for variation in the set up of the support or scaffolding system.

SUMMARY OF THE INVENTION

One object of the present invention is to provide a support system which provides a great deal of flexibility in the manner in which the system is erected.

Another object is to provide a bracket that greatly facilitates the attachment of cross-bracing and tie-bars to legs of the support system.

Another object is to provide such a bracket which may be secured to the leg at any position along its length.

Another object is to provide a system that can be quickly dismantled.

Other objects of this invention will be apparent to those skilled in the art in light of the following description and accompanying drawings.

In accordance with this invention, generally stated, a vertical support grid system is provided. The grid system includes vertically extending legs, cross-bracing diagonally spanning the distance between said legs, and tie-bars horizontally spanning the distance between said legs. A bracket secures the tie-bars and cross-bracing to the legs. The bracket includes a bracket connector having first and second generally U-shaped mating halves. Each half has a web and a pair of legs defining pin holes extending from opposite ends of the web. At least one of the halves has an arm extending from its web in a direction opposite from the connector legs. The bracket is secured to the grid legs at a desired location by a pin extending through the first and second connector leg pin holes and the grid legs. The connector arms receive the tie-bars and the cross-bracings to connect them to the grid legs.

To vertically stack beams, to make the grid support legs, one of the connector halves is longer than the other and a third generally U-shaped portion matable with the longer half is provided. The longer half and the third U-shaped portion define a tube which receives the stacked beams to produce the grid legs. The longer half and the third portion are secured to said pair of vertically stacked beam.

A plate may be secured to the web of one of the connector halves to be placed over an end of the grid leg.

One of the connector halves may include a pair of vertically extending ears defining a channel therebetween and an internally threaded block spanning the channel at a top of the ears, allowing the bracket to receive a threaded bolt for leveling a load.

DESCRIPTION OF THE PREFERRED EMBODIMENT

Figure 1:
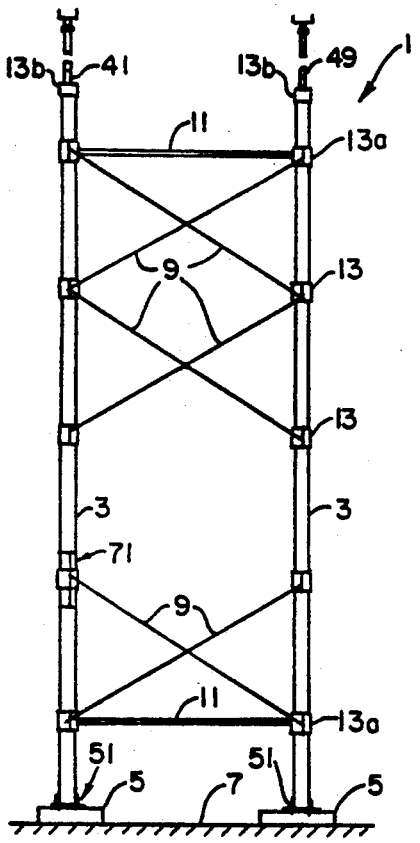
FIG. 1 is a diagramatic side elevational view of a grid support system of the present invention.

Referring now to the FIG. 1, reference numeral 1 indicates an illustrative embodiment of a grid support system of the present invention. Grid 1 includes a plurality of vertical legs 3 which stand on a base 5. Base 5 sits on the ground 7. A plurality of diagonal cross-beams 9 and tie-bars 11 extend between legs 3 to provide support to the system 1. A plurality of brackets 13 are used to secure cross-beams 9 and tie-bars 11 to the legs. Brackets 13 may be modified, as will be explained below, to perform other functions as well.

Figure 2:
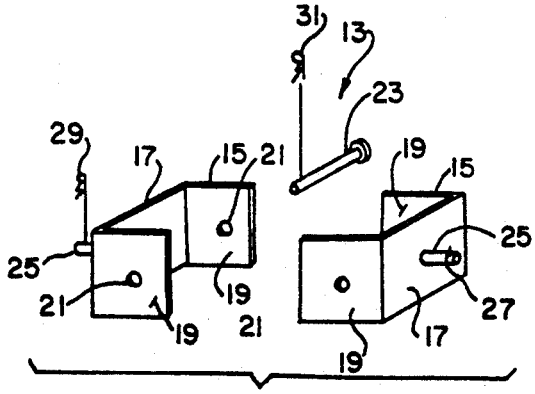
FIG. 2 is an isometric exploded view of a bracket of the support system used for attaching cross-bars to legs of the support system.

Bracket 13 includes two matable halves 15 which are identical. Each half includes a web 17 and two parallel legs 19 extending perpendicularly from web 17. Legs 19 include aligned holes 21 which receives a pin 23. An arm 25 extends outwardly from web 17 and has a hole 27 which receives a cotter pin 29. See FIGS. 2 and 3.

To secure bracket 13 to leg 3, a hole is formed in the leg at any desired location. Bracket halves 15 are then placed around leg 3 so as to form a box around leg 3. Bracket leg holes 21 are lined up with each other, and aligned with the hole formed in leg 3. Pin 23 is then inserted through the holes, and a cotter pin 31 is placed through a hole in pin 23 to secure pin 23 in place. Pin 23 thus securely holds bracket 13 to leg 3. As will be apparent, bracket 13 may be secured to any desired portion of the leg 3. Thus, support system 1 has a great deal of flexibility in the manner in which it can be assembled.

To secure cross-bars 9, a hole is formed at the end of the cross-bar through which arm 25 can extend. The arm in this application will be extending laterally. Arm 25 is sufficiently long so that hole 27 is exposed and cotter pin 29 is inserted in hole 27, securing cross-bar 9 to bracket 13. In this manner of connection, cross-bar 9 can pivot with respect to bracket 13, providing flexibility in the construction of the support system 1.

Figure 3:
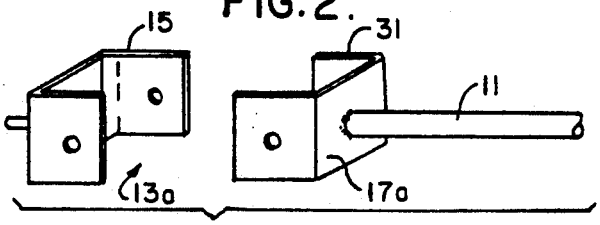
FIG. 3 is an isometric exploded view of the bracket modified to secure tie-bars to the legs.

Turning to FIG. 3, to secure tie-bar 11 to legs 3, a bracket 13*a* is used having a first half 15 and a second half 31. Half 31 is substantially the same as half 15, but does not have arm 25. Bracket 13*a* is secured to leg 3 in the same manner as bracket 13. To secure tie-bar 11 to bracket 13*a*, it is welded or otherwise secured to web 17*a* of bracket half 31. Bracket half 31 could have an opening formed in web 17*a* through which tie-bar 11 would extend, allowing tie-bar 11 to be secured to bracket 13*a* using a nut. As is apparent, the only half necessary to secure tie-bar 11 to bracket 13*a* is half 31 and bracket half 31 can be used by itself. When bracket half 15 is used in conjunction with bracket half 31, a cross-bar and tie-bar can be secured to substantially the same place on leg 3 quickly and easily.

Figure 4:
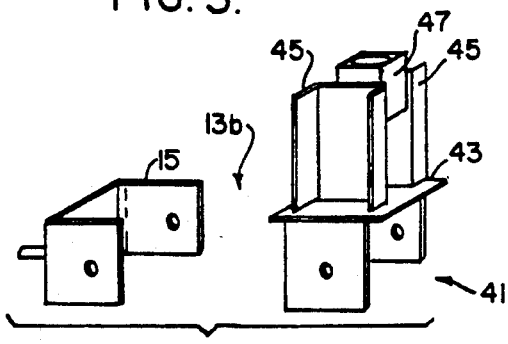
FIG. 4 is an exploded isometric view of the bracket modified for use as a leveler on top of the legs.
Figure 5:
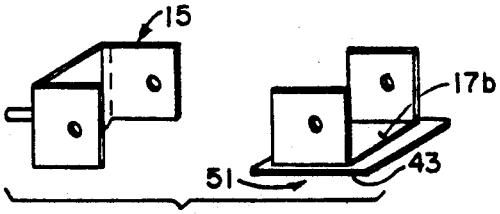
FIG. 5 is an exploded isometric view of the bracket modified for use as a base plate.

Turning to FIG. 4, the basic bracket can be modified to perform a leveling function. As shown, bracket 13*b* has a bracket half 41 provided with a plate 43 secured to web 17*b*, as can be more clearly seen in FIG. 5. A pair of spaced vertically extending members 45 are secured to the opposite side of the plate 43 to have flat surfaces facing each other. Members 45 are preferably generally U-shaped to provide structural strength to the members. A nut 47 is secured between members 45 at an upper portion of the members. Nut 47 receives a threaded bolt 49. (See FIG. 1) Bracket half 41 is secured to either the top or bottom of leg 3, with web 17*b* covering the end of the leg. Bracket half 41 can thus be used to provide a leveling function, either of the support system itself, or of a load carried by the support system. As can be appreciated, because bracket half 41 is applied over the top of the leg, it can be used with one or both of bracket halves 15 and 31.

Turning again to FIG. 5, a bracket half 51 is shown. Bracket half 51 is bracket half 41 less members 45 and nut 47, and includes only plate 43 secured to web 17*b*. Like bracket half 41, bracket half 51 can be secured to the end of legs 3 to provide a base when base 5 is uneven and leveling is not necessary.

Figure 6:
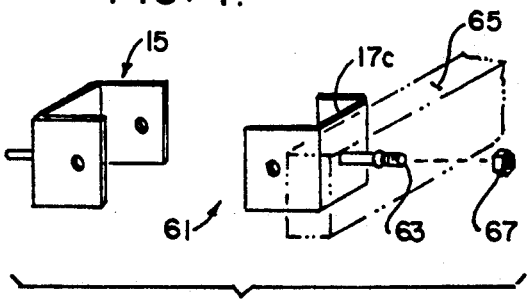
FIG. 6 is an exploded isometric view of the bracket modified to secure additional bracing to the legs.

In FIG. 6, the basic bracket half has been modified as at 61 to include a threaded arm 63 secured to web 17*c* to secure cross-beams to the bracket. This may be used to secure heavier cross-beams, such as a wood stripping tie 65 to the bracket. A nut 67 is threaded on to arm 65 to secure tie 65 to the bracket. This configuration can also be used to secure cross-beam 9 to the bracket.

Figure 7:
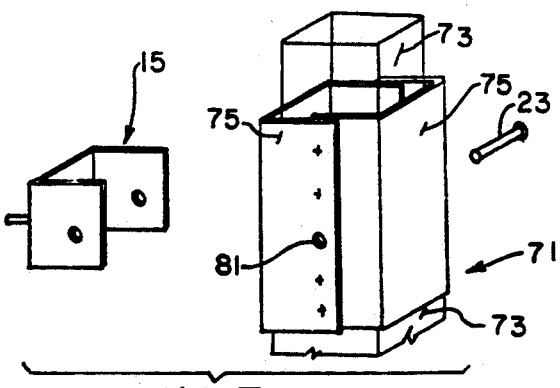
FIG. 7 is an exploded isometric view of the bracket modified to splice two lengths of material together.

In FIG. 7, a splice 71 is shown. Splice 71 can be used to vertically stack beams 73 to form elongated segments, such as a leg 3. Splice 71 includes a two halves 75, each of which has a web 77 and legs 79 extending perpendicularly from web 77. Legs 77 have holes 81 to receive pin 23. To connect beams 73, beams 73 are placed end-to-end, and splice halves 75 are placed therearound. Nails or other fastening means are used to secure splice 71 to the beams. By forming a hole in the spliced beams, the leg may be used in conjunction with one of the other bracket halves, such as bracket half 15. To avoid the need to form a hole in beams 73 after they are spliced together, the two beams may be spaced from each other a distance sufficient to accommodate the passage of pin 23 between the legs.

As can be seen, my support system provides a plurality of bracket halves which may be used in combinations of two, three, or even four, providing great flexibility in the manner in which a support system is constructed.

Numerous variations, within the scope of the appended claims, will be apparent to those skilled in the art in light of the foregoing description and accompanying drawings. These variations are merely illustrative.

Having thus described the invention, what is claimed and desired to be secured by Letters Patent is:

1. A vertical support grid system including vertically extending legs, cross-bracing diagonally spanning the distance between said legs, tie-bars horizontally spanning the distance between said legs, and bracketing means for securing said tie-bars and cross-bracing to said legs, said bracketing means comprising a bracket connector including first and second generally U-shaped mating halves, each of said half having a web and a pair of legs extending therefrom, each leg having aligned pin holes therethrough, said bracketing means being secured to said vertically extending legs at a defined location by locating said mating halves on opposite sides of the vertically extending legs and aligning the pin holes of the extending legs, at least one pin extending through the holes of the bracket connector legs and through said grid legs to affix the bracket connector to the vertically extending legs, and said bracket connector receiving one of said tie-bars and said cross-bracing to connect them to said grid system vertically extending legs.

2. A vertical support grid system including vertically extending legs, cross-bracing diagonally spanning the distance between said legs, tie-bars horizontally spanning the distance between said legs, and bracketing means for securing said tie-bars and cross-bracing to said legs, said bracketing means comprising a bracket connector including first and second generally U-shaped mating halves, each said half having a web and a pair of legs extending therefrom, each leg having aligned pin holes extending therethrough, at least one of said halves having an arm extending from said web in a direction opposite from said extending legs, said bracketing means being secured to said vertically extending legs at a defined location by a pin extending through said connector leg pin holes an said grid legs, said bracket connector receiving one of said tie-bars and said cross-bracing to connect them to said grid system legs, one of said connector halves being longer than the other, said connector further including a third generally U-shaped portion matable width said longer half, said longer half and said third U-shaped portion defining a tube which receives a pair of vertically stacked beams while producing said grid legs, said longer half of said third portion being secured to said pair of vertically stacked beams.

3. The grid system of claim 2 wherein one of said connector halves includes a plate attached to its web, said connector being placed over an end of said grid leg.

4. The grid system of claim 3 wherein said one connector half includes a pair of vertically extending ears defining a channel therebetween and an internally threaded block spanning said channel at a top of said ears, said block receiving a threaded bolt for leveling a load.

5. A bracket for securing tie-bars and cross-bracing to vertical legs of a vertical support grid system, said bracket including first and second generally U-shaped mating halves, each said half having a web and a pair of legs extending from opposite ends of said web, each leg having aligned pin holes extending therethrough, at least one of said halves having an arm extending from said web in a direction opposite from said connector legs, said bracket secured to said grid leg at a selected location by a pin extending through said first and second bracket leg pin holes and said grid legs, said connector arm receiving one of said tie-bars and said cross-bracings to connect it to said grid legs, one of said bracket halves being longer than the other, said bracket further including a third generally U-shaped portion matable with said longer half, said longer half and said third U-shaped portion defining a tube which receives a pair of the vertical legs of the vertical support grid system, said longer half of said third portion being secured to said pair of vertically stacked grid system legs.

6. The bracket of claim 5 wherein one of said bracket halves includes a plate attached to its web, said bracket being placed over an end of said grid leg.

7. The bracket of claim 6 wherein said one bracket half includes a pair of vertically extending ears defining a channel therebetween and an internally threaded block spanning said channel at a top of said ears, said block receiving a threaded bolt for leveling a load.

8. A method of erecting a vertical support grid system having vertically extending legs, cross-bracing diagonally spanning the distance between said legs, tie-bars horizontally spanning the distance between said legs, and bracket connectors;

said bracket connectors having first and second generally U-shaped mating halves, each said half having a web and a pair of legs extending therefrom, each leg having aligned pin holes extending therethrough, at least one of said halves having an arm extending from said web in a direction opposite from said connector legs, and being a series of said bracket connectors provided along the height of the vertically extending legs forming the grid system;

securing said bracket connector to said vertically extending leg at select locations on said legs;

securing opposite ends of said cross-bracing to select connector arms;

securing opposite ends of said tie-bars to select of said connector arms;

said step of securing said bracket connectors to said grid legs includes forming a pin hole in said grid leg at a select location, placing said first and second connector halves on said grid leg so that connector leg pin holes are aligned with said grid leg pin holes, placing a pin through said pin holes and securing said pin in said pin holes;

the securing of said bracket connectors to said legs at select locations on said legs includes the step of longitudinally stacking a desired number of said vertically extending legs, securing said vertically extending legs within a channel defined by a third-shaped member, and securing said bracket connector to said third member.

* * * * *